US008015744B1

(12) United States Patent
Swan

(10) Patent No.: US 8,015,744 B1
(45) **Date of Patent: *Sep. 13, 2011**

(54) FOLDING REAR SIGHT WITH DUAL PURPOSE SIGHTING ELEMENTS

(75) Inventor: Richard E. Swan, E. Bridgewater, MA (US)

(73) Assignee: Atlantic Research Marketing Systems, Inc., West Bridgewater, MA (US)

( * ) Notice: Subject to any disclaimer, the term of this patent is extended or adjusted under 35 U.S.C. 154(b) by 180 days.

This patent is subject to a terminal disclaimer.

(21) Appl. No.: 11/949,421

(22) Filed: Dec. 3, 2007

Related U.S. Application Data

(63) Continuation-in-part of application No. 10/939,962, filed on Sep. 14, 2004, now Pat. No. 7,356,962.

(51) Int. Cl.
*F41A 15/00* (2006.01)

(52) U.S. Cl. ..... 42/147; 42/133; 42/137; 42/138; 42/140; 42/148

(58) Field of Classification Search ..... 42/133, 42/137, 140, 141, 147, 148
See application file for complete search history.

(56) References Cited

U.S. PATENT DOCUMENTS

| | | | | |
|---|---|---|---|---|
| 308,699 | A | 12/1884 | Rabbeth | |
| 396,043 | A | 1/1889 | Lyman | |
| 404,599 | A * | 6/1889 | Carver | 42/140 |
| 426,887 | A | 4/1890 | West | |
| 561,360 | A * | 6/1896 | Taylor | 42/140 |
| 564,514 | A | 7/1896 | Fuller | |
| 805,770 | A | 11/1905 | Bassell et al. | |
| 878,857 | A | 2/1908 | Bevier | |
| 894,755 | A | 7/1908 | Snedden | |
| 1,034,925 | A | 8/1912 | Newitt | |
| 1,089,009 | A | 3/1914 | Porter | |
| 1,198,295 | A * | 9/1916 | Ward et al. | 42/136 |
| 1,257,713 | A | 2/1918 | Johnson | |
| 1,260,907 | A | 3/1918 | Johnson et al. | |
| 1,276,572 | A | 8/1918 | Rogers | |
| 1,433,422 | A * | 10/1922 | Spencer | 42/140 |
| 1,602,116 | A | 10/1926 | Manahan et al. | |
| 1,908,019 | A | 5/1933 | Howard | |
| 2,032,648 | A | 3/1936 | Bliss | |
| 2,093,676 | A | 9/1937 | Hennessy | |

(Continued)

FOREIGN PATENT DOCUMENTS

| | | |
|---|---|---|
| DE | 151669 | 6/1904 |

(Continued)

*Primary Examiner* — Michelle Clement
(74) *Attorney, Agent, or Firm* — Barlow, Josephs & Holmes, Ltd.

(57) ABSTRACT

A folding rear sight includes a base member and a spring-loaded sight housing that deploys into an operational position with a simple release lever. The sight includes two separate dual-purpose aiming elements, one fixed, and one that rotates between an inactive position and an active position in front of the fixed element. The top aiming end of the fixed aiming element includes a large diameter close quarter battle (CQB) aperture and an vertically extending sighting notch configured and arranged above the large CQB aperture. The top aiming end of the rotatable aiming element includes a smaller, long-range sighting aperture and an elongated vertically extending sighting notch configured and arranged above the smaller sighting aperture. The dual-purpose aiming elements provide standard aperture sights for situations where the soldier has reasonable time to aim the weapon. The notched sights above the apertures provide a larger, open sighting window, which is easier to align in stressful close combat situations, as well as long range sighting.

14 Claims, 9 Drawing Sheets

U.S. PATENT DOCUMENTS

| | | | | | |
|---|---|---|---|---|---|
| 2,276,446 | A | | 3/1942 | Zimmerman | |
| 2,331,903 | A | | 10/1943 | Garand | |
| 2,334,300 | A | | 11/1943 | Williams | |
| 2,437,363 | A | | 3/1948 | Smith | |
| 2,444,038 | A | | 6/1948 | Garand | |
| 2,724,897 | A | | 11/1955 | Hough | |
| 2,806,288 | A | | 9/1957 | Sarvis | |
| 2,871,566 | A | * | 2/1959 | Everitt | 42/137 |
| 2,939,217 | A | | 6/1960 | Hajek | |
| 3,930,316 | A | | 1/1976 | Tellie | |
| 3,969,827 | A | | 7/1976 | Ellis | |
| 4,665,622 | A | | 5/1987 | Idan | |
| 4,691,442 | A | | 9/1987 | Center | |
| 4,957,211 | A | | 9/1990 | Ekkert et al. | |
| 4,993,158 | A | * | 2/1991 | Santiago | 42/135 |
| 5,533,292 | A | | 7/1996 | Swan | |
| 6,490,822 | B1 | | 12/2002 | Swan | |
| 6,568,118 | B1 | | 5/2003 | Teetzel | |
| 6,606,813 | B1 | | 8/2003 | Squire et al. | |
| 6,615,530 | B2 | | 9/2003 | Johansson | |
| 6,622,415 | B1 | | 9/2003 | Canaday et al. | |
| 6,722,075 | B1 | | 4/2004 | Gabaldon | |
| 6,732,467 | B1 | * | 5/2004 | Luth | 42/138 |
| 6,779,290 | B1 | | 8/2004 | Houtsma | |
| 6,968,643 | B2 | | 11/2005 | Woodbury | |
| 7,076,907 | B2 | | 7/2006 | Nesseth et al. | |
| D526,380 | S | | 8/2006 | Swan | |
| 7,181,882 | B2 | | 2/2007 | Woodbury | |
| 2003/0140546 | A1 | * | 7/2003 | Kay | 42/133 |

FOREIGN PATENT DOCUMENTS

| | | |
|---|---|---|
| GB | 1272 | 7/1906 |
| GB | 169397 | 8/1921 |

* cited by examiner

FOLDING REAR SIGHT WITH DUAL PURPOSE SIGHTING ELEMENTS

CROSS-REFERENCE TO RELATED APPLICATIONS

This application is related to and claims priority from earlier filed U.S. Provisional Patent Application No. 60/511,878, filed Oct. 16, 2003, the contents of which are fully incorporated herein by reference.

The Application is also a continuation-in-part of currently pending U.S. patent application Ser. No. 10/939,962 filed Sep. 14, 2004.

BACKGROUND OF THE INVENTION

The present invention relates generally to sighting devices for weapons. More specifically, the present invention relates to a low profile configuration for a folding rear sight.

Generally, sighting mechanisms for firearms are bulky and protrude outside the firearm's general contour. This construction creates a greater opportunity for the sighting mechanism to be caught on clothing or brush while the firearm is being carried thereby knocking the sighting mechanism out of alignment. Prior art devices that have attempted to address this problem by allowing removal of the sighting mechanism or providing a hinged attachment of the sighting mechanism. Generally, however, the prior art devices require that each time the sighting mechanism is moved into the active position, the sighting mechanism must be re-aligned before it is ready for use. Although this re-alignment step may be acceptable when the firearm is used in a controlled environment such as a firing range, it is not acceptable for a firearm employed for field use, such as hunting or combat environments where immediate, fully aligned use of the sight is required.

This is of particular concern in the field of combat firearms. A firearm that is used in the field requires a sighting mechanism that is stowed out of the way during times of non-use, thereby providing a streamlined profile that is not likely to be bumped out of alignment. Further, the sight must be quickly deployed when needed. The readiness time for the sighting mechanism to move from the stowed or inactive position to the deployed position must be minimized. Additionally, when moved from the stowed position to the deployed position, the sight must be fully and accurately aligned In prior art devices, such as disclosed in U.S. Pat. No. 5,533,292, issued to Swan, a self-aligning flip-up sight provides a spring-loaded mechanism that can be easily moved from a storage position to an active position without requiring re-alignment of the sights. However, this device has a relatively large vertical profile, even when it is in stowed position. The large profile results from the use of two iron peep sights mounted in an "L" shape at a 90° angle relative to one another. In order for the sighting mechanism to be moved into the stowed position, the L-shaped iron sight must be placed into a position that allows one of the legs to lie parallel to the firearm with the other leg pointing upwardly. If the iron sight assembly is not in this position, the mechanism cannot be moved into the stowed position. Further, when the iron sight assembly is in the proper stowed position, one of the legs extends upwardly from the upper surface of the firearm thereby requiring that the protective shoulders of the sight extend a sufficient distance to protect this protruding leg. Accordingly, the sighting mechanism has a profile that is larger than desired and which tends to interfere with the mounting of additional accessories above the sight. Specifically, if a user wishes to mount an optical telescopic sight in addition to the retractable sight, an additional spacer would be necessary to allow the required clearance.

In addition, as the military becomes more involved in close quarter battle (QCB) situations, it has been identified that another perceived shortcoming of the prior art is that conventional back-up iron sights including aperture type sighting elements are sometimes difficult to use in close quarter battle, and/or not versatile enough to provide both CQB sighting and long range sighting. For example, the prior art Swan sight as disclosed in the '292 patent includes a first close quarter battle aperture which has a fairly large diameter, and a second long-range aperture which has a smaller aperture. With both sights, the weapon is aimed by aligning the rear aperture with the front post sight. In CQB situations, it is necessary to quickly sight in a target. The use of a larger aperture is effective in non-combat, practice-range situations to provide a bigger sight window in order to line up the front post, but has not been found to be ideal in actual combat where it is critical to get the weapon on target with minimal effort. In addition, while the second sight with the smaller aperture provides more accurate sighting in less stressful situations where there is more time to aim, the sight still only has a single fixed range.

In view of the foregoing, there is a perceived need for an improved folding rear sight which has a low profile when stored, which has the ability to consistently and quickly deploy to a fully-zeroed position, and which can provide versatile aiming capabilities both in CQB situations and longer distance aiming.

BRIEF SUMMARY OF THE INVENTION

In this regard, the present invention provides a folding rear sight comprised of three major component assemblies, namely a base, a sight housing and an aiming assembly.

The sight housing contains the aiming system. The aiming system is comprised of two independent aiming elements mounted on a central windage adjustment screw positioned within the sight housing. The first aiming element is configured and arranged in a fixed upright position generally perpendicular to a central support region of the sight housing. The second aiming element is rotatably movable relative to the first aiming element between a first active position generally perpendicular to the central support region and parallel to the first aiming element and a second inactive position generally parallel to the central support region and perpendicular to the first aiming element. The top aiming end of the first aiming element includes a larger-diameter close quarter battle (CQB) sighting aperture, while the top aiming end of the second aiming element a second smaller-diameter long-range sighting aperture.

Accordingly, when the large aperture sight is desired, the small aperture sight can be folded down out of the way of the large aperture. Further, when the sight housing is placed into the stored position, i.e. folded down against the base, the two elements of the aiming system can fold against one another allowing the sight housing to store tightly against the base while preventing one of the sighting elements from protruding outwardly from the firearm.

In a second embodiment of the invention, the aiming system includes two dual-purpose aiming elements. In this regard, the top aiming end of the fixed aiming element includes a large diameter close quarter battle (CQB) aperture and an elongated vertically extending sighting notch configured and arranged above the larger CQB aperture. Similarly, the top aiming end of the second, rotatable aiming element includes a smaller, long-range sighting aperture and an elongated vertically extending sighting notch configured and arranged above the smaller sighting aperture. The second long range aiming element is slightly taller in height than the CQB element and that the second sighting notch is longer than the first sighting notch.

Accordingly, it is an object of the present invention to provide a sighting mechanism for a firearm that includes at least two aiming elements and has a compact profile when placed into a storage position. It is a further object of the present invention to provide a sighting mechanism for a firearm that can be retracted to a low profile storage position against the contour of the firearm while being quickly and easily deployable to a fully aligned active position. It is yet a further object of the present invention to provide a retractable sighting assembly for a firearm that includes at least two user selectable aiming elements that can be fully retracted into a low profile storage position against the contour of the firearm.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
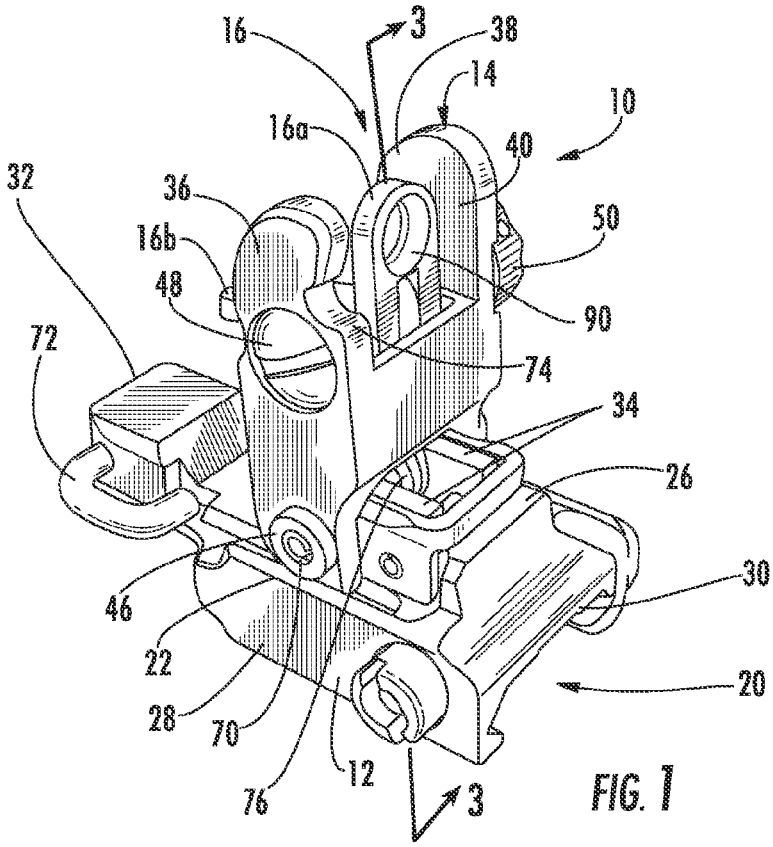
FIG. 1 is a front perspective view of the flip up sight of the present invention in the deployed position with the large-aperture aiming element in the active position.

Now referring to the drawings, the folding rear sight of the present invention is shown and generally illustrated at 10 in the drawing figures. In particular, the present invention provides folding rear sight 10 having a reduced vertical profile when in the stowed position. This feature allows improved shielding and protection of the aiming elements within the sighting device 10 when in the stowed position.

Figure 5:
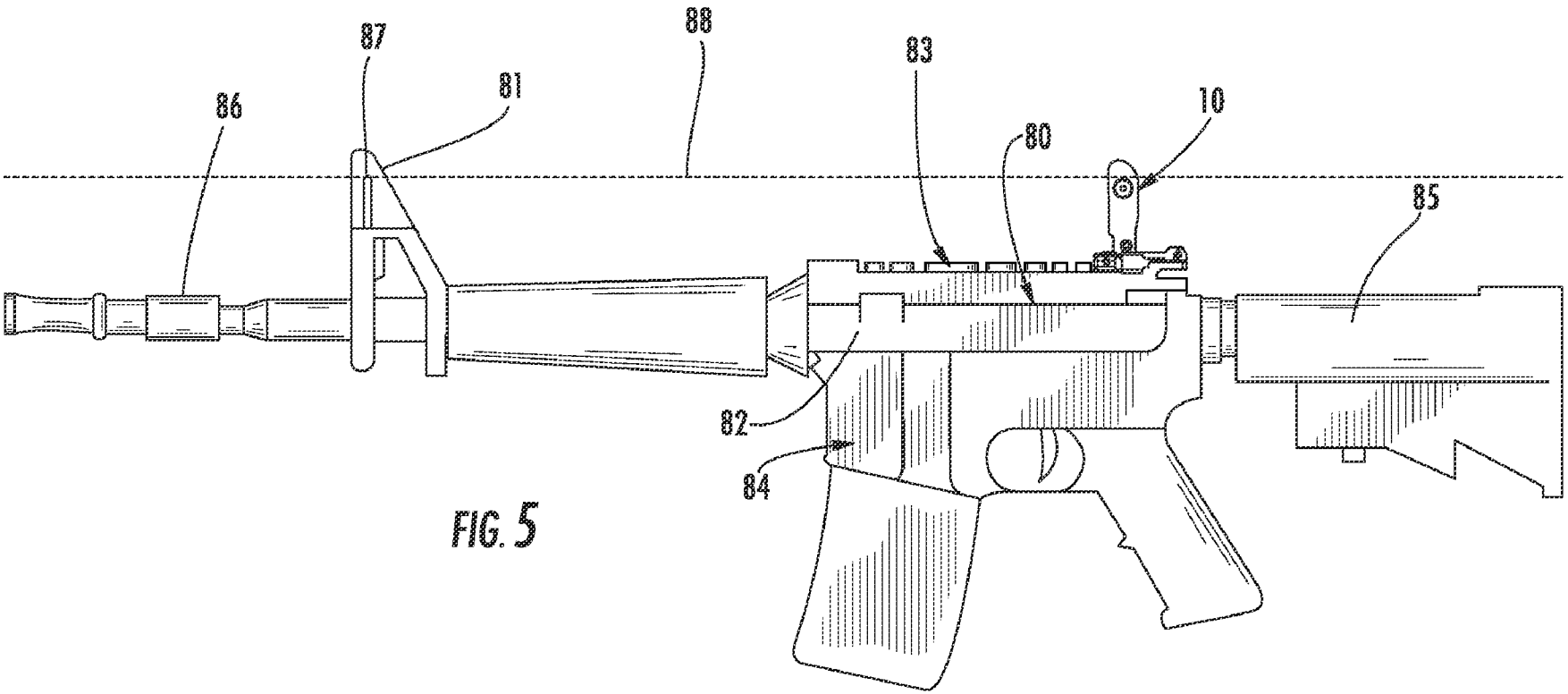
FIG. 5 is a side view of a firearm with the folding rear sight in the deployed position and showing a line of sight (shown in broken line) from the rear sight aperture to the front sight post.
Figure 6:
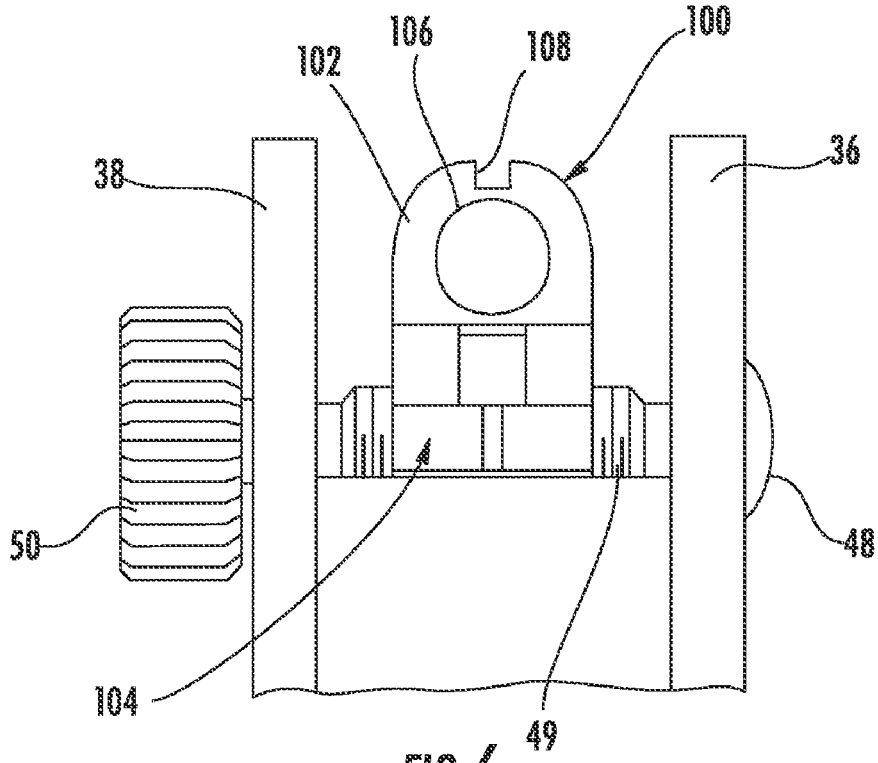
FIGS. 6 and 7 are enlarged rear views of the folding rear sight in the deployed position showing an alternative embodiment of the aiming assembly including notched aperture aiming elements.

Referring briefly to FIG. 5, the folding rear sight 10 is used as the rear sight on an M4/M16 type rifle generally indicated at 80 (M4 and M16 are trademarks of Colt Manufacturing Inc.). The weapon 80 employs both a front sight 81 and the present rear sight 10 for aiming. The weapon 80 generally includes an upper receiver 82 with a longitudinal dovetail rail 83, as well as a lower receiver 84, a butt stock 85 and a barrel 86. The front sight 81 is mounted on the front end of the barrel 86 and comprises an upright post 87. The tip of the post 87 is placed on the target and aligned within the sight window of the rear sight 10 to provide a longitudinal line of sight 88 (shown in broken lines) along the length of the weapon 80.

The folding rear sight 10 of the present invention includes three major components: a base generally indicated at 12, a sight housing generally indicated at 14, and an aiming assembly generally indicated at 16.

Turning now to FIG. 1, the base 12 is formed to include a dovetail interface 20 to allow the sight 10 to be mounted onto any dovetail rail. The base has 12 an upper surface 22 and a lower surface 24, wherein the lower surface 24 has a cross-sectional profile that is configured to interface with the dovetail shape of a typical dovetail rail 83. The base 12 includes a right side 26, a left side 28, a front 30 and rear 32 wherein the right side 26 and left side 28 include interface members 20 for grabbing onto the dovetail rail. Two identical, vertical and parallel mounting tabs 34 extend upward from the base 12 upper surface 22. A spring trough resides between the tabs 34.

The sight housing 14 has two parallel side plates, a catch plate 36 and a windage adjustment plate 38. The sight housing 14 further includes an upper support region 40 defined between the catch plate 36 and the adjustment plate 38. The upper support region 40 is configured to retain and protect the aiming elements 16*a*, 16*b*. The sight housing 14 also includes a lower interface region 42 which includes an inside surface bounded by the catch plate 36. The sight housing 14 is rotatably mounted to the base 12 by a mounting pin 70, which extends through aligned apertures formed in the side plates 36, 38 and in the mounting tabs 34. The sight housing 14 is movable relative to the base 12 between a first inactive position adjacent the base 12 (see FIG. 4), and a second active position generally perpendicular to the base 12 (see FIGS. 1, 2 and 3).

Figure 2:
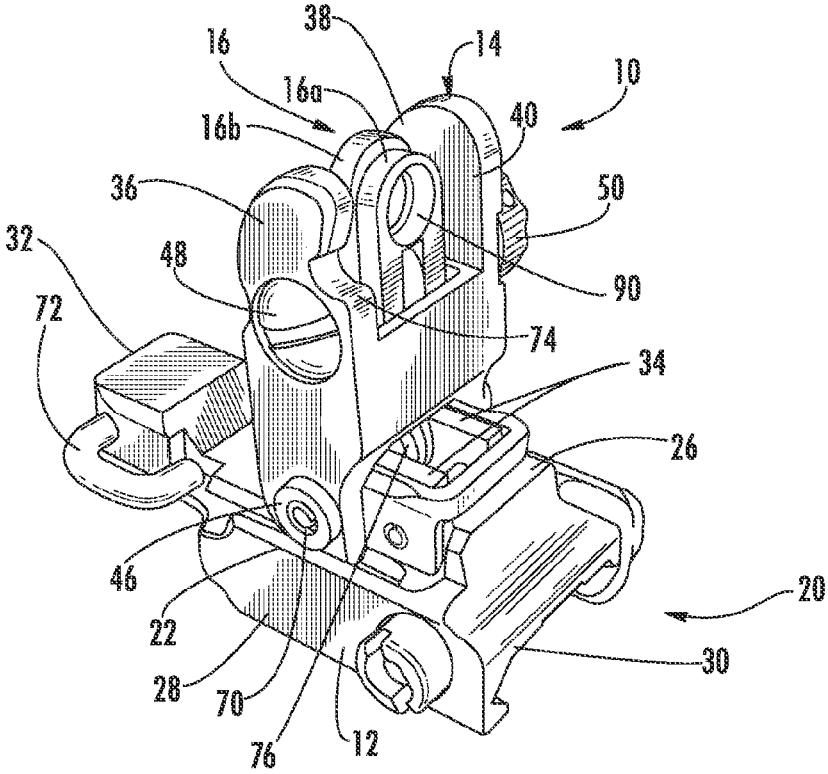
FIG. 2 is a front perspective view of the flip up sight of the present invention in the deployed position with the small-aperture aiming element in the active position.
Figure 3:
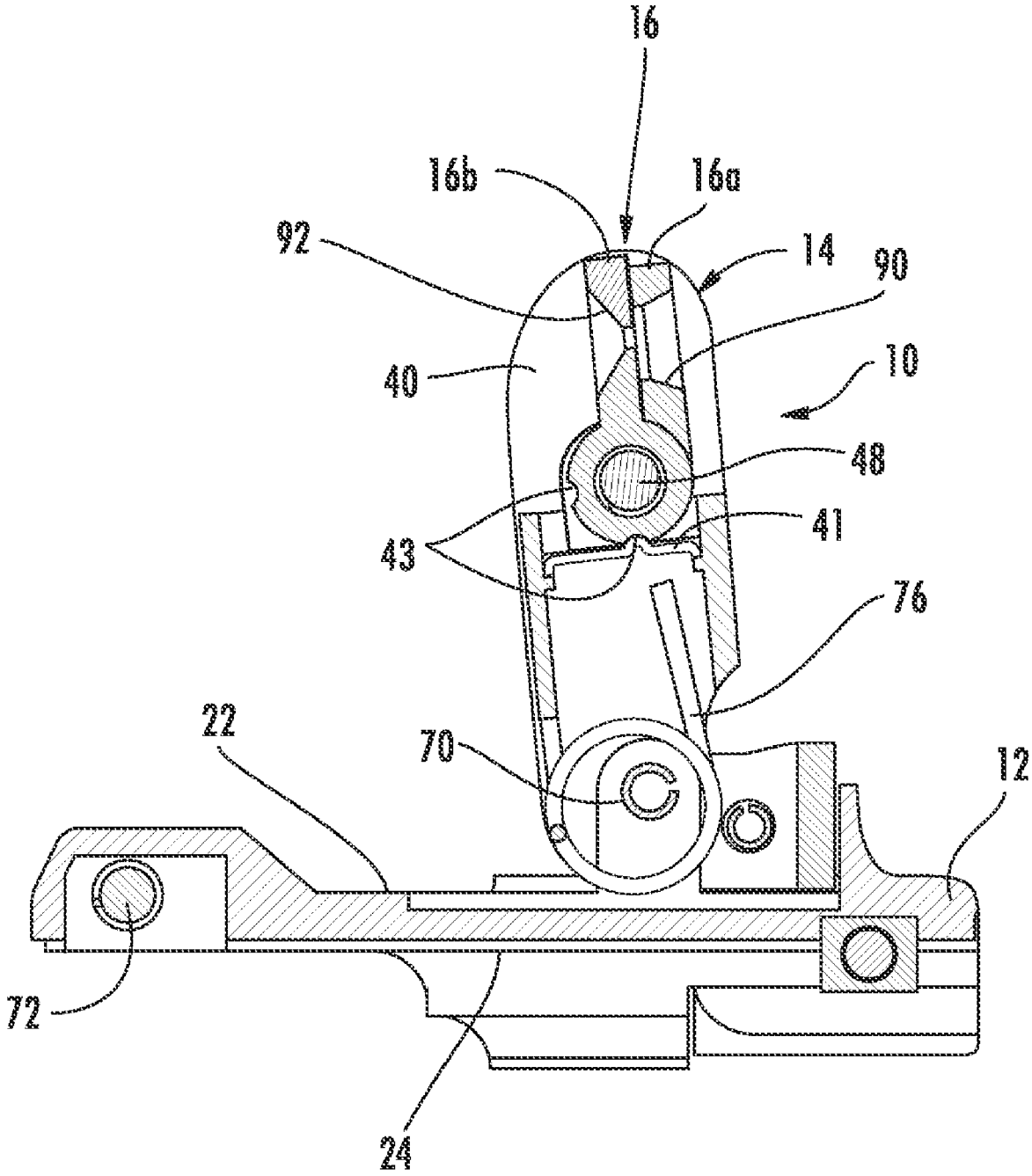
FIG. 3 is a cross-sectional view taken along the line 3-3 of FIG. 1.

A torsion spring 76 is received around the mounting pin 70 and engaged with both the base 12 and the sight housing 12 to normally bias the sight housing 14 toward the deployed or active position (FIGS. 1, 2, 3).

Figure 4:
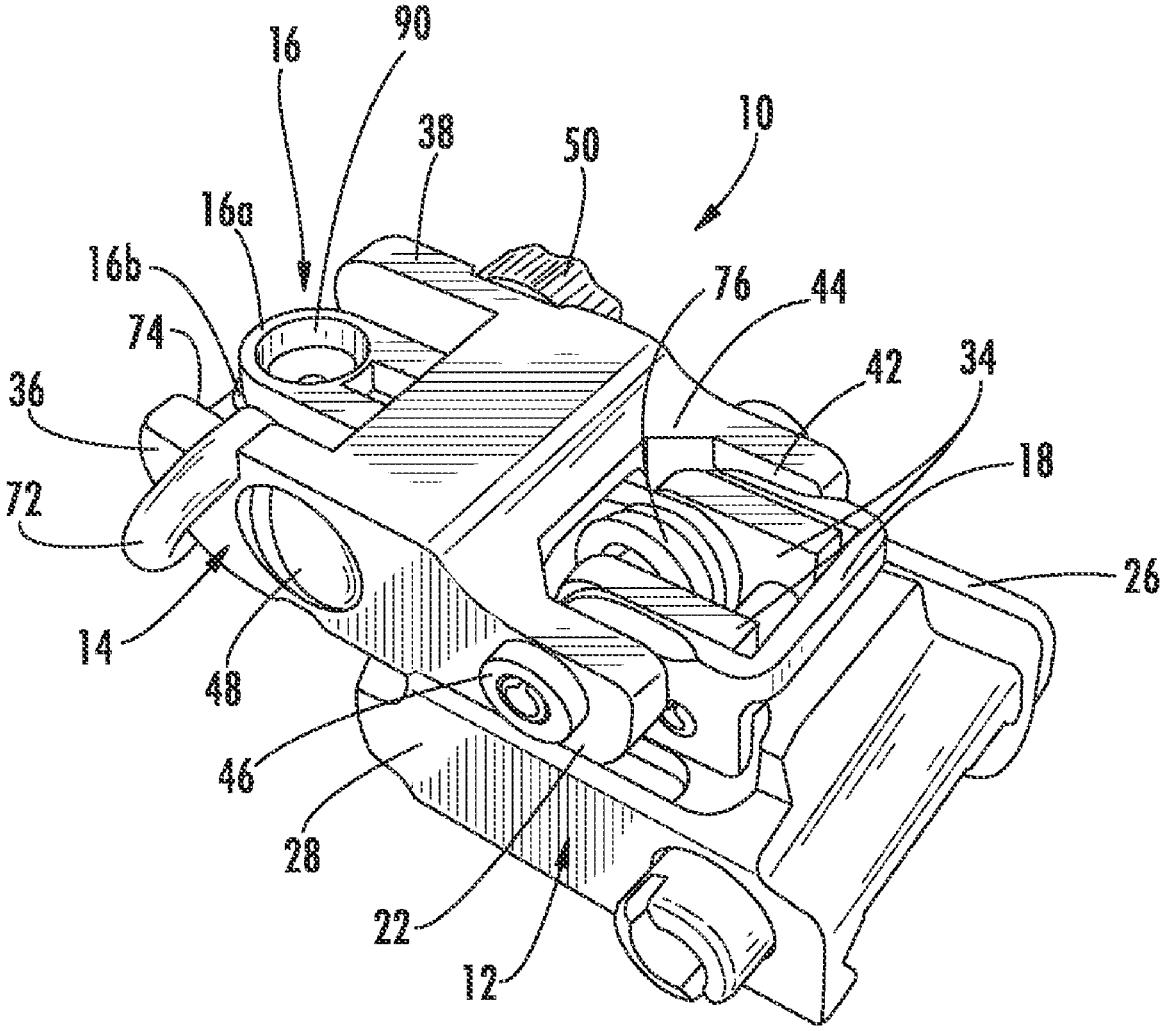
FIG. 4 is a perspective view of the flip up sight in the stowed position.

As can best be seen in FIGS. 1, 2 and 4, a release clamp 72 is provided to hold the sight housing 14 in the stowed (inactive) position. The release clamp 72 engages a notch 74 formed in the catch plate 36 thereby holding the sight housing 14 in the stowed position. The release clamp 72 is mounted in a bore which is drilled into the base 12. A torsion spring (not shown) is also mounted in the bore thereby providing resistive force against rotation of the release clamp 72. In use, rotating the release clamp 72 away from the sight housing 14 disengages the clamp 72 from the slot 74 in the sight housing 14 and allows rotation of the sight housing 14 from the inactive stowed position to the deployed active position.

Figure 1A:
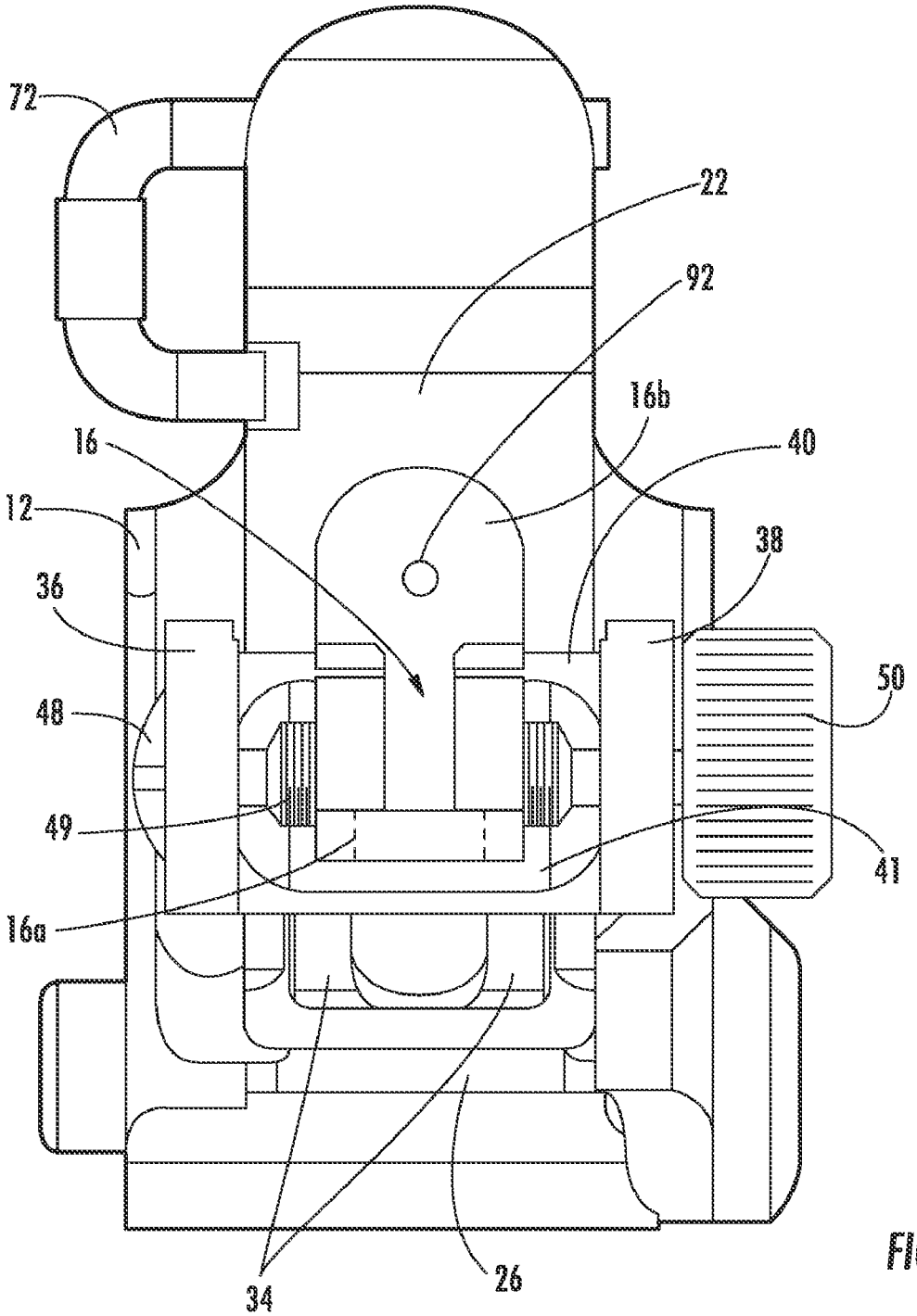
FIG. 1A is a top view thereof.

Referring to FIGS. 1-4, the aiming assembly 16 is mounted within the central support region of the upper section of the sight housing. The aiming assembly includes a windage adjustment screw 48 having a centrally threaded shaft 49 rotatably mounted between the opposing sidewalls 36, 38. A first aiming element 16*a* has a top aiming end and a bottom mounting end that is threadedly mounted on the shaft 49 of the windage adjustment screw 48. Likewise, a second aiming element 16*b* has a top aiming end and a bottom mounting end is rotatably (but not threadedly) mounted on the shaft 49 of the windage adjustment screw 48. The bottom end of the first aiming element 16*a* includes threaded apertures (not shown) to engage with the threaded shaft 49 of the windage screw 48, whereas the bottom end of the second aiming element 16*b* includes straight-walled apertures having a diameter slightly larger than the diameter of the threads. A windage adjustment knob 50 is secured to the terminal end of the shaft 49 and provides the ability to rotate the windage adjustment screw 48 to move the aiming elements to the left and right within the sight housing, i.e. windage adjustment. In this regard, the first aiming element 16*a* is configured and arranged in a fixed upright position generally perpendicular to the central support region. As can be seen in FIGS. 1, 1A, and 2, the bottom mounting end of aiming element 16*a* includes spaced mounting legs which are threadedly mounted on the threaded shaft 49.

Figure 3B:
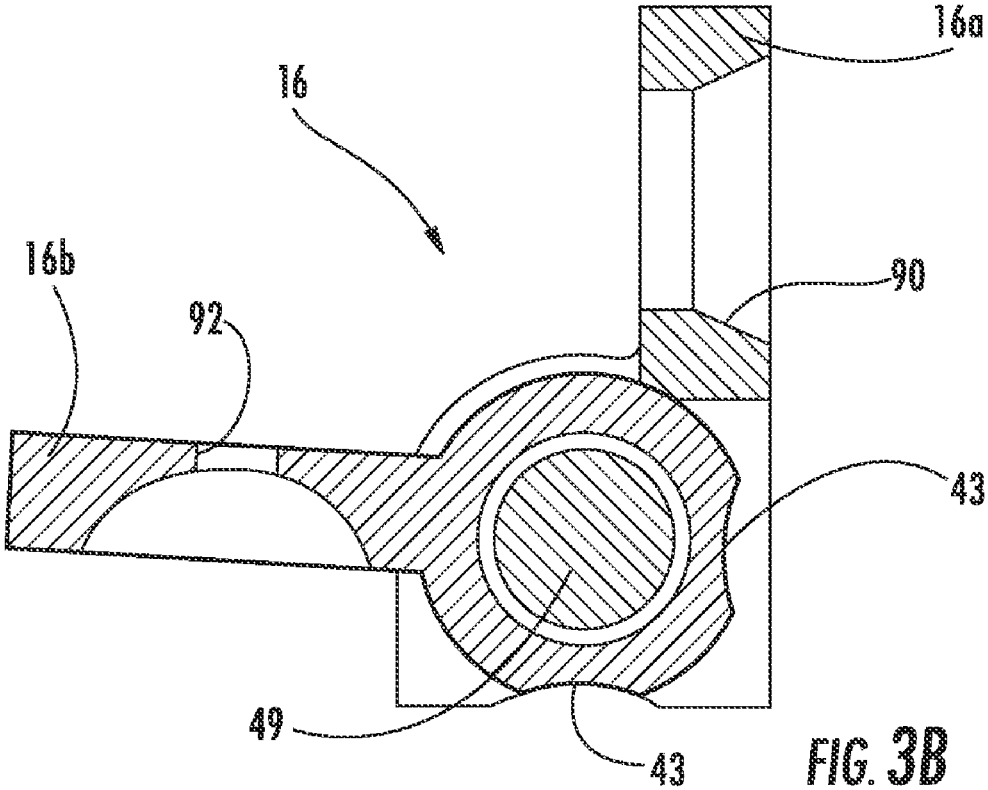
FIG. 3B is an enlarged cross-sectional view of the aiming elements with the second small-aperture aiming element in the down (inactive) position.

The second aiming element 16*b* is rotatably movable relative to the first aiming element 16*a* between a first active position generally perpendicular to the central support region and parallel to the first aiming element (see FIGS. 2, 3, 3A and 4) and a second inactive position generally parallel to the central support region and perpendicular to the first aiming element 16*a* (see FIGS. 1, 1A, and 3B). As can be seen in FIGS. 1, 1A, and 2, the bottom mounting end of aiming element 16*b* includes a single mounting leg positioned between the spaced mounting legs of aiming element 16*a*. The straight-walled aperture of element 16*b* allows element 16*b* to slide back and forth along the threaded shaft 49 as it travels left and right with element 16*a*.

Figure 3A:
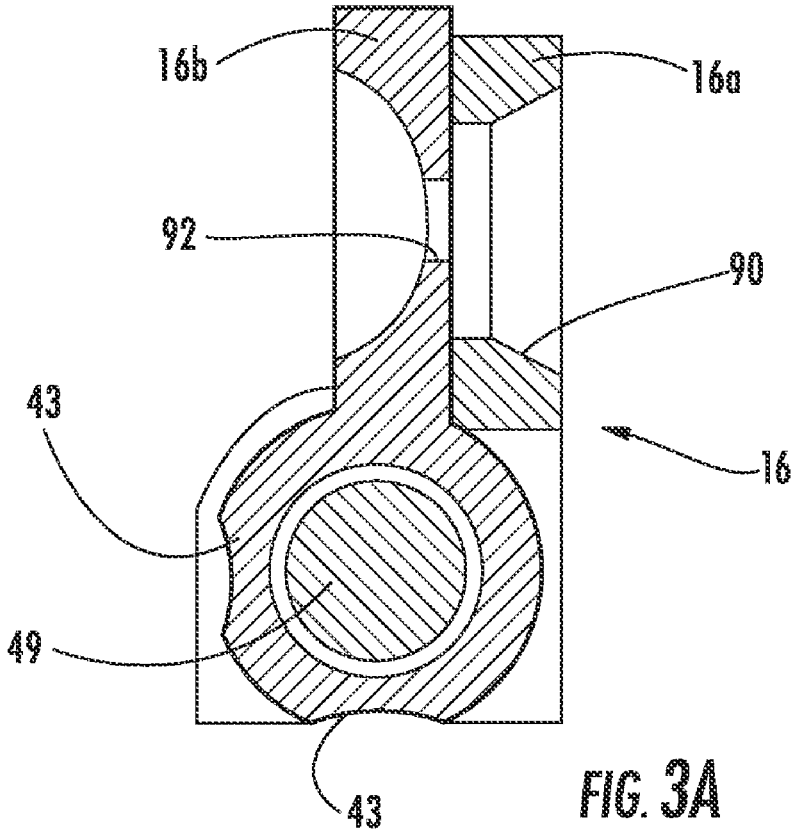
FIG. 3A is an enlarged cross-sectional view of the aiming elements with the second small-aperture aiming element in the active position.

Referring to FIGS. 3A and 3B, the top aiming end of the first aiming element 16*a* includes a first larger-diameter close quarter battle (CQB) sighting aperture 90, while the top aiming end of the second aiming element 16*b* includes a second smaller-diameter long-range sighting aperture 92. When the second aiming element 16*b* is moved to the inactive position (FIG. 1, 1A, 3B), the CQB aperture 90 is visible to the shooter and provides a larger sight window for close quarter target acquisition. This larger sight window is generally used for CQB targeting between 50 and 200 meters. When the second aiming element 16*b* is moved to the active position (FIGS. 2, 3, 3A), the smaller, long-range sight aperture 92 is visible to the shooter and provides a smaller sight window for long-range targets. As is well known in shooting, the target will appear much smaller at the longer distance and will thus still fit within the small sight window. As best seen in FIGS. 3 and 3A, the center of the smaller-diameter, long-range aperture 92 is slightly higher than the center of the larger-diameter CQB aperture 90 to provide appropriate elevation for the longer range. This window is generally set up for a range of about 300 meters.

A leaf spring 41 is captured between the bottom wall of the upper support region 40 and the bottom mounting ends of the aiming elements 16*a*, 16*b* and applies pressure against the bottom mounting ends of the aiming elements 16*a*, 16*b*. Detents 43 in the outer surface of the single mounting leg of the aiming element 16*b* engage with the leaf spring 41 to resiliently hold in the selected position.

It should be noted that when the sight housing 14 is in the retracted position, both of the aiming elements 16*a* and 16*b* are folded flat against one another and rest flat against the profile of the firearm 80 (see FIG. 4). The aiming elements 16*a* and 16*b* in this position are shielded by the catch plate 36 and the adjustment plate 38.

Figure 7:
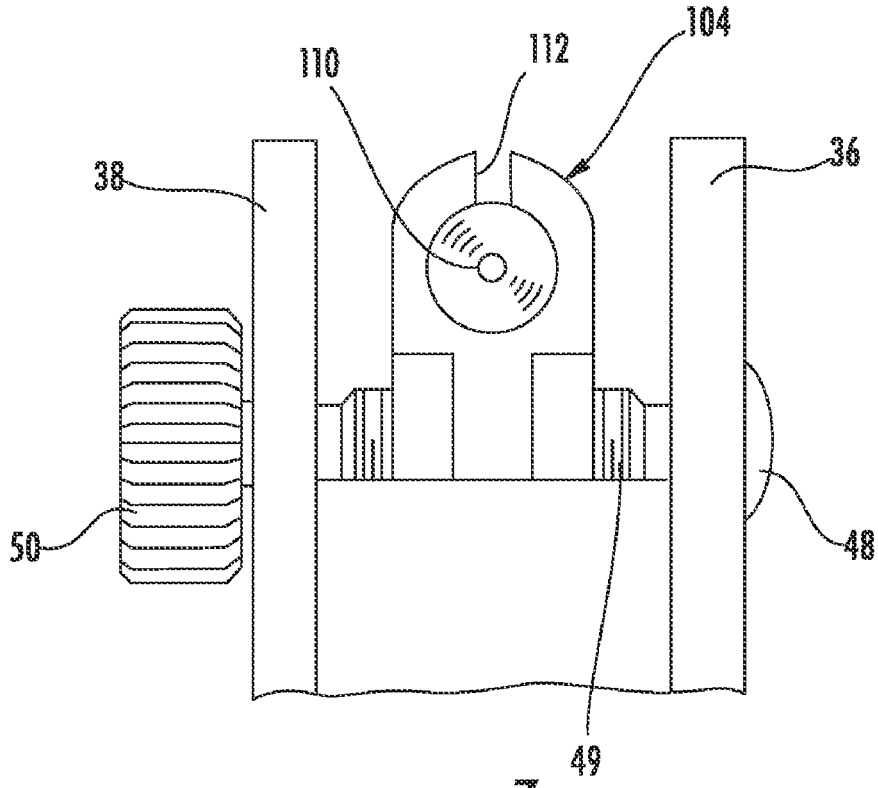
Figure 8:
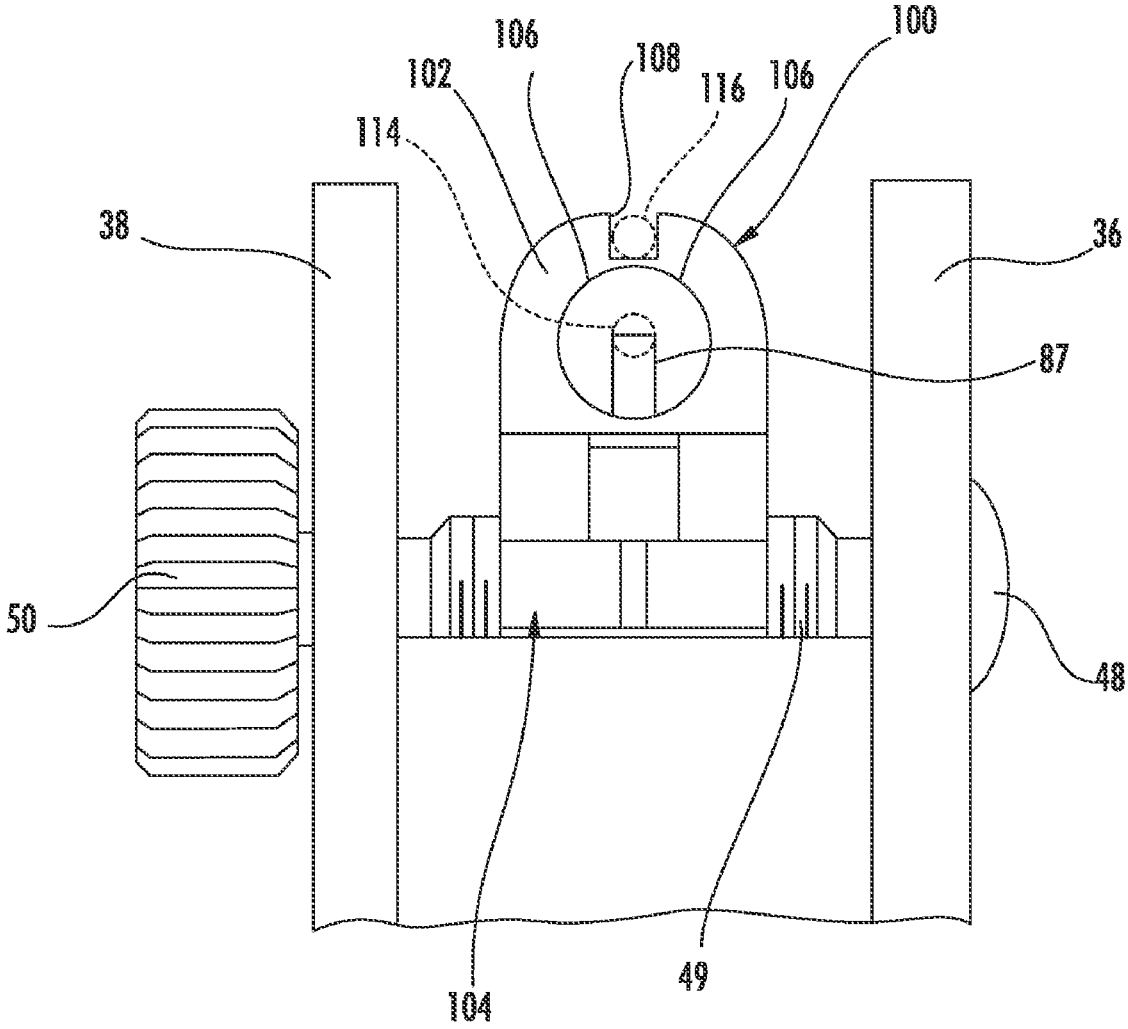
FIG. 8 is an enlarged rear view of the alternative aiming assembly showing the sight picture as viewed with the large-aperture CQB aiming element.
Figure 9:
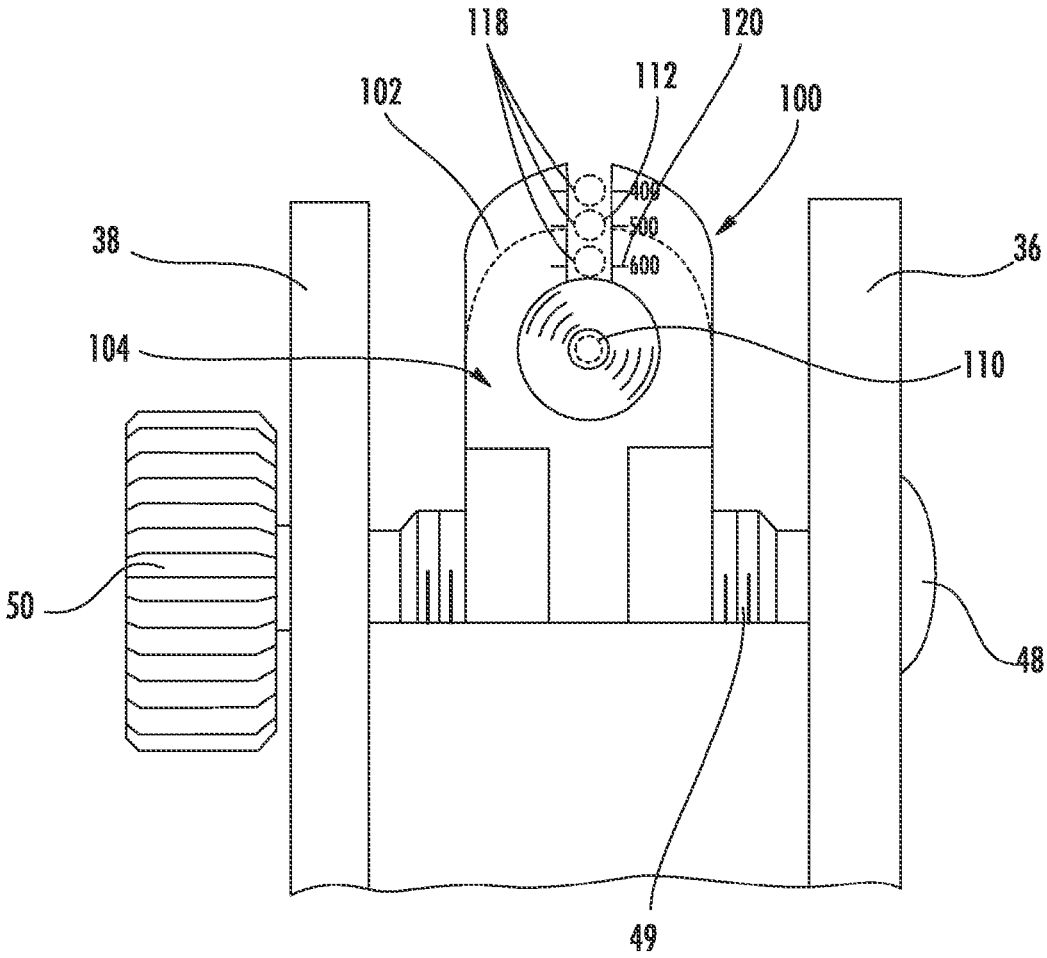
FIG. 9 is an enlarged rear view of the alternative aiming assembly showing the sight picture as viewed with the smaller-aperture long distance aiming element in the active position.

Turing now to FIGS. 6-9, an alternative aiming assembly is illustrated and generally indicated at 100. The aiming assembly 100 is generally similar to the previously described aiming assembly 16 but instead includes two dual-purpose aiming elements 102, 104 which will be described in further detail hereinafter. As in the previously described assembly 16, one of the aiming elements 102 is a fixed element, and one of the aiming elements 104 rotates between an inactive position (FIGS. 6 and 8) and an active position in front of the fixed element (FIGS. 7 and 9).

As discussed in the background, it has been identified by soldiers who have actively been involved in close quarter battle, that it is sometimes difficult to quickly and accurately sight a target using an aperture sight (closed window). The sight window of an apertured sight is partially obstructed by the annular frame of the aperture and under stressful situations it is perceived to be more difficult to align the front post inside the frame of the aperture. It is believed by the applicant that under stressful combat situations, it is more intuitive, quicker and more accurate to site a close target using a notched sight (open window), similar to that used on many pistols. The notched sight has more open space above the sight and provides better visibility. Accordingly, the Applicant seeks to provide the aiming characteristics of a pistol in addition to the aperture sights already provided.

In this regard, the top aiming end of the fixed aiming element 102 includes a large diameter close quarter battle (CQB) aperture 106 and a vertically extending sighting notch 108 configured and arranged above the larger CQB aperture 106. Similarly, the top aiming end of the rotatable aiming element 104 includes a smaller, long-range sighting aperture 110 and an elongated vertically extending sighting notch 112 configured and arranged above the smaller sighting aperture 110. Referring to FIG. 9, as in the first embodiment 16, it can be seen that the second long range aiming element 104 is slightly taller than the CQB element 102 and that the second sighting notch 112 is taller than the first sighting notch 108.

More specifically, referring to FIG. 8, the first CQB sighting aperture 102 is configured and arranged to provide a large sight window having a range of approximately 50-200 meters. A central sighting point within the window is indicated by circle 114 shown in dotted lines. The front sight post 87 is seen aligned in the center of the aperture 106. The first sighting notch 108 is configured and arranged to provide an open notch sight having a sighting point represented by circle 116 shown in broken lines. As indicated above, it is believed that it is quicker and easier to align the front sight post 87 within the notch 108 in stressfull situations. In CQB situations, ranging (elevation) is not as critical and it is more important to get the target aligned and to hit the target somewhere than to carefully place a shot.

Now referring to FIG. 9, the aiming element 104 is configured and arranged with a smaller sight window 110 having a range of approximately 300 meters, similar to the first embodiment. The second sighting notch 112 is configured and arranged to provide a notched sight that can also be used in CQB situations, for example, when the second aiming element 104 with the smaller aperture 110 is deployed in the active position. In this regard, when a combat situation changes quickly, the soldier does not have to flip the element 104 out of the way for CQB sighting. Bullseye shooting is not required in CQB, and if you hit your target six (6) inches above where the round would have been placed with the round aperture 106 or 110, the results are basically the same.

The notches 108 and 112 are therefore always available for CQB sighting, not matter how the elements 102, 104 are oriented, thus making the sight 100 much more versatile.

In addition, the elongated notch 112 provides an elongated vertical sight window having a range of 400-600 meters as represented by circles 118 shown in broken lines (400-500-600 meters). Hash marks 120 can be marked on the surface of the element to provide fixed elevation marks for aiming. It is noted that there is a significant difference in height between the 300 meter aperture sight 110 and the 400 meter position in the notch 112. This height difference results from a significant decrease in velocity of the projectile after traveling 300 meters. The projectile starts to drop after 300 meters and the sights must accommodate this drop for accurate shot placement.

It is also noted that the sighting ranges specified herein are not intended to be limiting to the invention. As is well known in the art, the actual range of the sights depends on many factors, such as height of the front sight post 87 and the length of the barrel 86 of the weapon. Raising and lowering the height of the front sight post 87 changes the range, or elevation, of the sight when aligned with the rear sight. Raising the front sight post 87 will decrease the range while lowering increases the range. Also, the length of the barrel 86 further affects the range of the sights. For a given height of the front sight post 87 aligned with a fixed rear sight 10, a weapon with a longer barrel (20 inches) will have a different sight range than a weapon with a shorter barrel (14 inches), It can therefore be seen that the present invention provides an improved sighting device 10 that has a smaller and more compact profile when placed into a storage position as compared to the sighting devices in the prior art. The dual-purpose aiming elements provide standard aperture-type sight windows 106, 110 for situations where the soldier has reasonable time to aim the weapon. The notched sights 108, 112 above the apertures 106, 110 provide larger, open sighting areas, which are easier to align in stressful close combat situations. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A folding rear sight for use with a firearm comprising:

a base member having a top surface and a bottom surface configured and arranged to be mounted on an upper receiver of a firearm;

a sight housing having an upper section and a lower section configured and arranged to be rotationally movable relative to said top surface of said base, said sight housing being rotationally movable relative to said base member between a first inactive position adjacent said base member and a second active position generally perpendicular to said base member, said upper section including upwardly extending, opposing sidewalls that cooperate to define a central support region, a spring received and retained between said base member and said sight housing for normally biasing said sight housing to said active position;

a retainer configured and arranged to selectively engage said sight housing and selectively retain said sight housing in said inactive position; and an aiming assembly mounted within said central support region of said upper section of said sight housing, said aiming assembly including a windage adjustment screw rotatably mounted between said upwardly extending opposing sidewalls, a first aiming element having a top aiming end and a bottom mounting end mounted on said windage adjustment screw, and a second aiming element having a top aiming end and a bottom mounting end mounted on said windage adjustment screw, said first aiming element being configured and arranged in a fixed upright position generally perpendicular to said central support region, said second aiming element being rotatably movable relative to said first aiming element between a first active position generally perpendicular to said central support region and parallel to said first aiming element and a second inactive position generally parallel to said central support region and perpendicular to said first aiming element, said first and second aiming elements being movable laterally along a shaft portion of said windage adjustment screw responsive to rotation of said windage adjustment screw, said top aiming end of said first aiming element includes a first sighting aperture, and further wherein said top aiming end of said second aiming element includes a second sighting aperture having a smaller diameter than said first sighting aperture, each of said first and second aiming elements further including a respective sighting notch positioned above said sighting aperture.

2. A rear sight for use with a firearm comprising:

a sight housing;

an aiming assembly mounted within said sight housing, said aiming assembly including a first aiming element having a top aiming end and a bottom mounting end mounted on said sight housing, and a second aiming element having a top aiming end and a bottom mounting end rotatably mounted on said sight housing, said first aiming element being configured and arranged in a fixed upright position, said second aiming element being rotatably movable relative to said first aiming element between a first active position generally parallel to said first aiming element and a second inactive position generally perpendicular to said first aiming element, said top aiming end of said first aiming element including a first sighting aperture and an elongated vertically extending first sighting notch configured and arranged above said first sighting aperture, and further wherein said top aiming end of said second aiming element includes a second sighting aperture having a smaller diameter than said first sighting aperture and further including an elongated vertically extending second sighting notch configured and arranged above said second sighting aperture.

3. The rear sight of claim 2 wherein said second aiming element is taller than said first aiming element and said second sighting notch is longer than said first sighting notch.

4. The rear sight of claim 2 wherein said first sighting aperture is configured and arranged to provide a sight window having a range of approximately 0-100 meters, and further wherein said first sighting notch is configured and arranged to provide a sight window having a range of about 300 meters.

5. The rear sight of claim 2 wherein said second sighting aperture is configured and arranged to provide a sight window having a range of approximately 200 meters, and further wherein said second sighting notch is configured and arranged to provide a sight window having a range of 400-600 meters.

6. The rear sight of claim 3 wherein said second sighting aperture is configured and arranged to provide a sight window having a range of approximately 200 meters, and further wherein said second sighting notch is configured and arranged to provide a sight window having a range of 400-600 meters.

7. A folding rear sight for use with a firearm comprising:

a base member;

a sight housing configured and arranged to be rotationally movable relative to said base between a first inactive position adjacent said base member and a second active position extending upwardly from said base member, a spring received and retained between said base member and said sight housing for normally biasing said sight housing to said active position;

a retainer configured and arranged to selectively engage said sight housing and selectively retain said sight housing in said inactive position; and an aiming assembly mounted within an upper section of said sight housing, said aiming assembly including a windage adjustment screw, a first aiming element having a top aiming end and a bottom mounting end mounted on said windage adjustment screw, and a second aiming element having a top aiming end and a bottom mounting end mounted on said windage adjustment screw, said first and second aiming elements being movable laterally along a shaft portion of said windage adjustment screw responsive to rotation of said windage adjustment screw, said top aiming end of said first aiming element includes a first sighting aperture, and further wherein said top aiming end of said second aiming element includes a second sighting aperture having a smaller diameter than said first sighting aperture, each of said first and second aiming elements further including a respective generally rectangular sighting notch positioned above said sighting aperture.

8. The rear sight of claim 7 wherein at least one of said first and second aiming elements is configured and arranged to be rotatably movable on said windage screw relative to the other of said first and second aiming elements.

9. The rear sight of claim 7 wherein said second aiming element is configured and arranged to be rotatably movable on said windage screw relative to said first aiming element.

10. A rear sight for use with a firearm comprising:

a sight housing; and an aiming assembly mounted within said sight housing, said aiming assembly including a first aiming element having a top aiming end and a bottom mounting end mounted on said sight housing, and a second aiming element having a top aiming end and a bottom mounting end mounted on said sight housing, said top aiming end of said first aiming element including a first sighting aperture and an elongated vertically extending first sighting notch configured and arranged above said first sighting aperture, said top aiming end of said second aiming element including a second sighting aperture having a smaller diameter than said first sighting aperture and further including an elongated vertically extending second sighting notch configured and arranged above said second sighting aperture, said second aiming element being taller than said first aiming element and said second sighting notch being longer than said first sighting notch.

11. The rear sight of claim 10 wherein said first sighting aperture is configured and arranged to provide a sight window having a range of approximately 0-100 meters, and further wherein said first sighting notch is configured and arranged to provide a sight window having a range of about 300 meters.

12. The rear sight of claim 10 wherein said second sighting aperture is configured and arranged to provide a sight window having a range of approximately 200 meters, and further wherein said second sighting notch is configured and arranged to provide a sight window having a range of 400-600 meters.

13. The rear sight of claim 10 wherein at least one of said first and second aiming elements is configured and arranged to be rotatably movable relative to the other of said first and second aiming elements.

14. The rear sight of claim 10 wherein said second aiming element is configured and arranged to be rotatably movable on said windage screw relative to said first aiming element.

* * * * *